United States Patent [19]

Sato et al.

[11] Patent Number: 4,574,755

[45] Date of Patent: Mar. 11, 1986

[54] AIR/FUEL RATIO CONTROL DEVICE FOR A CARBURETOR

[75] Inventors: Toshihiko Sato; Shigeru Doi, both of Saitama, Japan

[73] Assignee: Honda Giken Kogyo Kabushiki Kaisha, Tokyo, Japan

[21] Appl. No.: 549,751

[22] Filed: Nov. 7, 1983

[30] Foreign Application Priority Data

Nov. 8, 1982 [JP] Japan ..... 57-195550
Nov. 12, 1982 [JP] Japan ..... 57-198469

[51] Int. Cl.[4] ..... F02M 5/08

[52] U.S. Cl. ..... 123/320; 261/39 D; 261/DIG. 19; 261/DIG. 67

[58] Field of Search ..... 123/320, 520, 519, DIG. 11, 123/330, 516; 261/68, 70, 39 D, 64 E, DIG. 19, DIG. 67

[56] References Cited

U.S. PATENT DOCUMENTS

| | | | |
|---|---|---|---|
| 3,825,238 | 7/1974 | Nishihara et al. | 261/DIG. 67 |
| 3,939,232 | 2/1976 | Higashigawa | 261/DIG. 67 |
| 4,013,741 | 3/1977 | Edmonston | 261/39 D |
| 4,191,716 | 3/1980 | Yamashita et al. | 261/39 D |
| 4,305,368 | 12/1981 | Phelan et al. | 123/516 |
| 4,377,146 | 3/1983 | Oniki et al. | 123/520 |
| 4,395,991 | 8/1983 | Miyachi et al. | 123/520 |

*Primary Examiner*—William A. Cuchlinski, Jr.
*Attorney, Agent, or Firm*—Lyon & Lyon

[57] ABSTRACT

An intake system for an internal combustion engine having an air/fuel ration control device for closing the vent on a float chamber. The increased pressure within the float chamber from the incoming fuel enrichens the air/fuel mixture to the engine. The vent closure is effected by a valve controller responsive to intake vacuum. The controller is activated by vacuum experienced during engine braking. A bistarter choke system is disclosed including means for disabling the air/fuel ratio control device using either a switching apparatus or the higher pressures within the choke mechanism.

17 Claims, 9 Drawing Figures

AIR/FUEL RATIO CONTROL DEVICE FOR A CARBURETOR

BACKGROUND OF THE INVENTION

The field of the present invention is vehicle carburetion and more specifically air/fuel mixture control.

Exhaust gas burning, or afterburn, may be experienced with internal combustion engines employed in vehicles such as motorcycles, automobiles and trucks when the engine is used for compression braking. Such uncontrolled afterburn is undesirable. One means which has been used for eliminating or reducing such afterburn is to enrichen the air/fuel mixture during such periods of vehicle deceleration with engine braking.

Prior systems have been employed for using the mechanism of enrichening the air/fuel mixture during engine braking. For example, two air passages have been employed in a carburetor having jets for each passage. At the time of deceleration, engine braking, one of the passages is automatically closed, thereby making the mixture richer. Such a system requires additional carburetor complication, including additional passages, jets and the like.

SUMMARY OF THE INVENTION

The present invention pertains to control of air/fuel mixture during engine braking. An overpressure may be created in the float chamber of a carburetor under certain engine operating conditions to induce increased flow to the carburetor jets. The pressurizing of the float chamber may be accomplished by controlling venting from the carburetor float chamber under conditions of high vacuum in the engine intake passage. Disablement of the mixture control system may also be achieved with the activation of a bistarter choke mechanism. In this way, conditions of the engine during warm-up as well as steady state engine conditions can be accommodated.

Accordingly, it is an object of the present invention to provide an improved mixture control system for an internal combustion engine, particularly to accommodate engine braking conditions. Other and further objects and advantages will appear hereinafter.

DETAILED DESCRIPTION OF THE PREFERRED EMBODIMENT

Figure 1:
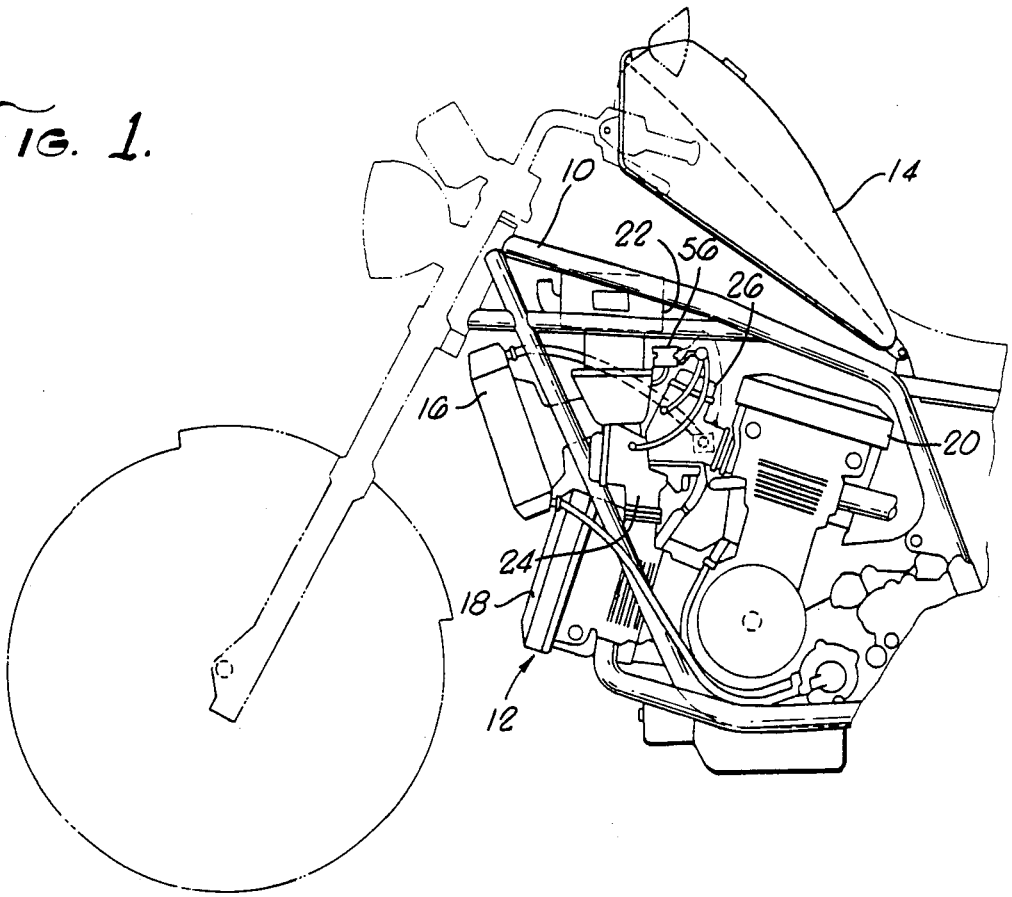
FIG. 1 is a side elevation of a motorcycle incorporating the present invention.

Turning in detail to the drawings, FIG. 1 illustrates a motorcycle having a body frame 10, a V-type engine 12, a fuel tank 14 and a cooling system 16. The V-type engine 12 includes two cylinder blocks and heads 18 and 20 forming a V-space for accommodation of the intake system therebetween. The intake system includes an air cleaner 22 and at least one carburetor 24 and 26 associated with each cylinder block and head 18 and 20.

Figure 2:
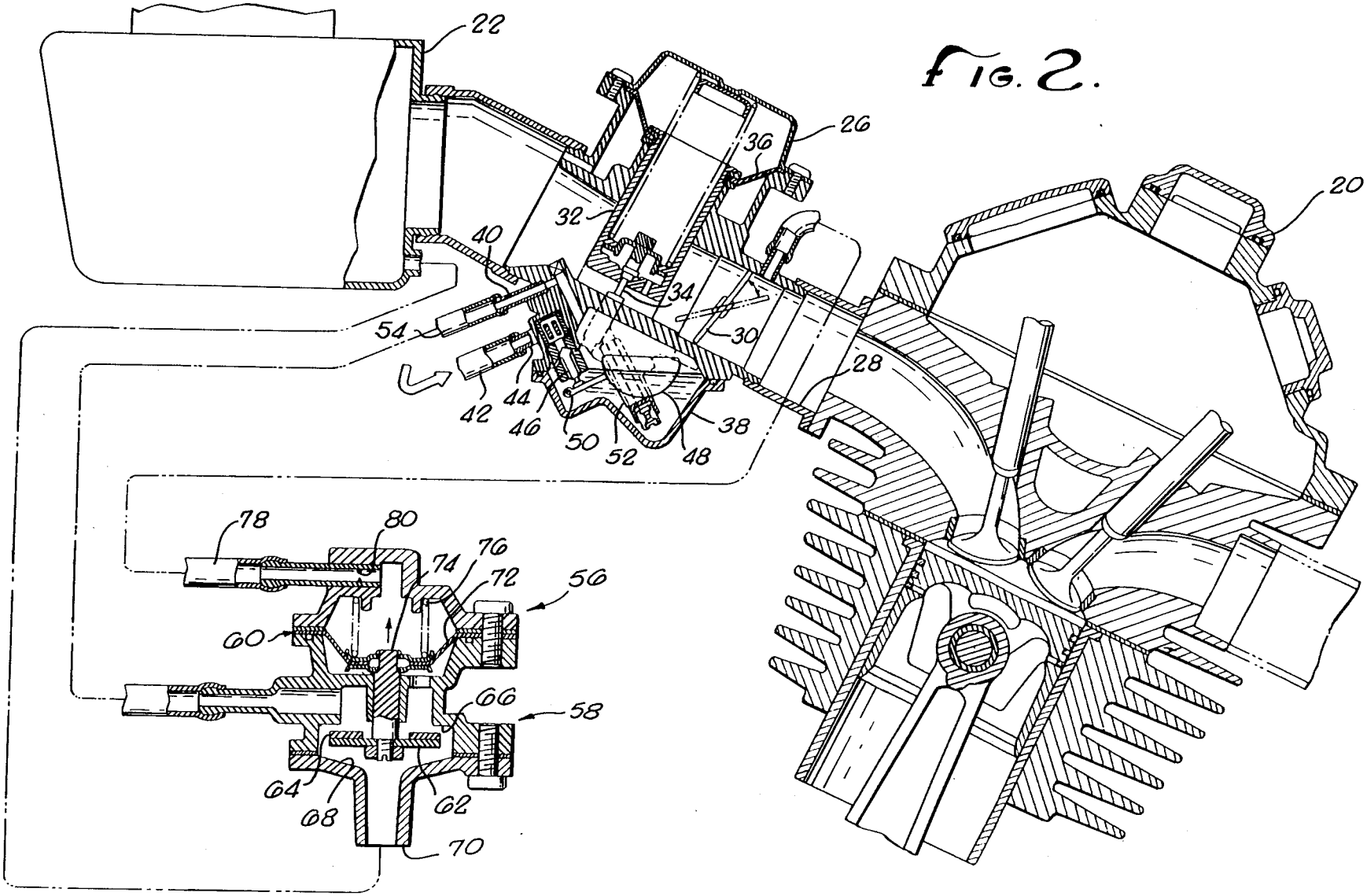
FIG. 2 is a cross-sectional elevation of an intake system of an internal combustion engine employing the present invention.

Looking to the cross section of FIG. 2, a cross-sectional view of the intake system and the attendant fuel supply system of a first embodiment of the present invention is illustrated. The carburetor 26 is in communication with and forms a part of an engine intake passage 28. The vacuum within the intake passage 28 is controlled by a throttle valve 30. The carburetor 26 illustrated in this embodiment includes a piston 32 to which is attached a needle 34 and which is supported by a diaphragm 36.

A float chamber 38 forms a part of the fuel supply system associated with the carburetor 26. The float chamber 38 is generally sealed and has an air vent 40. A fuel inlet means provides fuel to the float chamber 38. A fuel tube 42 extends from the fuel tank 14 to a fuel inlet passage 44. The fuel inlet passage 44 is controlled by means of a float valve 46. The float valve 46 includes a float 48 which is pivotally mounted relative to the float chamber 38 at a pivot 50. The float 48, pivoting about the pivot 50 with the variation in liquid level within the float chamber 38 actuates the float valve 46. In this way, fuel is admitted as needed to the chamber 38.

The pivot 50 is also illustrated as being forwardly of the float 48. The float valve 46 is positioned between the pivot 50 and the float 48. This arrangement places the float 48 rearwardly relative to the motorcycle in the float chamber 38. As a result, deceleration of the motorcycle will cause the fuel to move forwardly within the float chamber 38 and lower the float 48. This arrangement thereby gives the float mechanism a propensity to admit additional fuel during deceleration, a time of increased air/fuel mixture.

Also in communication with the float chamber 38 is a fuel jet passage means for delivering fuel from the float of the carburetor 26. The fuel jet passage means includes a jet passage 52 extending to the primary jet controlled by the needle 34. Thus, fuel is extracted as needed through the jet passage 52. The fuel supply is replenished through the fuel inlet passage 44 as controlled by the float mechanism. Venting of the air/fuel chamber 38 to accommodate variation in the fuel level is accomplished through the air vent 40. The incoming fuel through the fuel inlet passage 44 is generally pressurized above atmospheric pressure to insure proper flow into the chamber 38. This pressurization may occur by means of the placement of the fuel reservoir or tank. In the present case, the tank 14 is located above the carburetor 26 creating a pressure head. Alternatively, a fuel pump may be used where necessary or advantageous. Under normal operation, the volume of incoming fuel to the float chamber 38 does not overpressure the cavity because of the air vent 40.

The air vent 40 is generally a passage including a tube 54. The tube 54 extends to an air fuel ratio control device, generally designated 56. As will be seen, the air vent passage 40 may be controlled by the air fuel ratio control device 56 to selectively close the vent. With closure of the air vent passage 40, the incoming fuel to the float chamber 38 will result in an overpressure of the float chamber 38. As stated above, the fuel is pressurized above atmospheric. The air space within the float chamber 38 may be made small to increase the effect of variations in the level of fuel on the pressure. The pressure created by the unvented condition within the float chamber 38 increases the differential pressure along the jet passage 52. Consequently, increased flow of fuel is experienced to the carburetor float for carburetion. This adjustment is independent of the needle position 34, providing an increased amount of fuel at any needle position.

To control the air vent passage 40, the air/fuel ratio control device 56 includes a control valve assembly, generally designated 58, and a valve controller assembly, generally designated 60. The control valve 58 includes a valve member 62 having valve packing 64 for cooperation with a valve seat 66. The air vent passage 40 extends to the valve chamber 68 on one side of the valve 62 while a vent passage 70 extends from the valve chamber 68 on the other side of the valve 62 to the air cleaner 22. With actuation of the valve 62, the communication between the float chamber 38 to the air vent passage 40 to the vent passage 70 may be controlled.

The valve controller 60 includes a diaphragm 72 positioned within a cavity in the air/fuel ratio control device 56. The diaphragm 72 is coupled to the control valve 62 by means of a valve stem 74. On one side of the diaphragm 72 is a vacuum chamber for actuating the diaphragm 72. A bias spring 76 biases the diaphragm 72 toward an open position of the valve 62. A vacuum line 78 extends between the vacuum chamber on one side of the diaphragm 72 to the intake passage 28. In this way, a source of vacuum is available for acting on the diaphragm 72 to draw the diaphragm 72 upwardly against the bias spring 76 which in turn closes the valve member 62. An orifice 80 acts to moderate this action.

Figure 3:
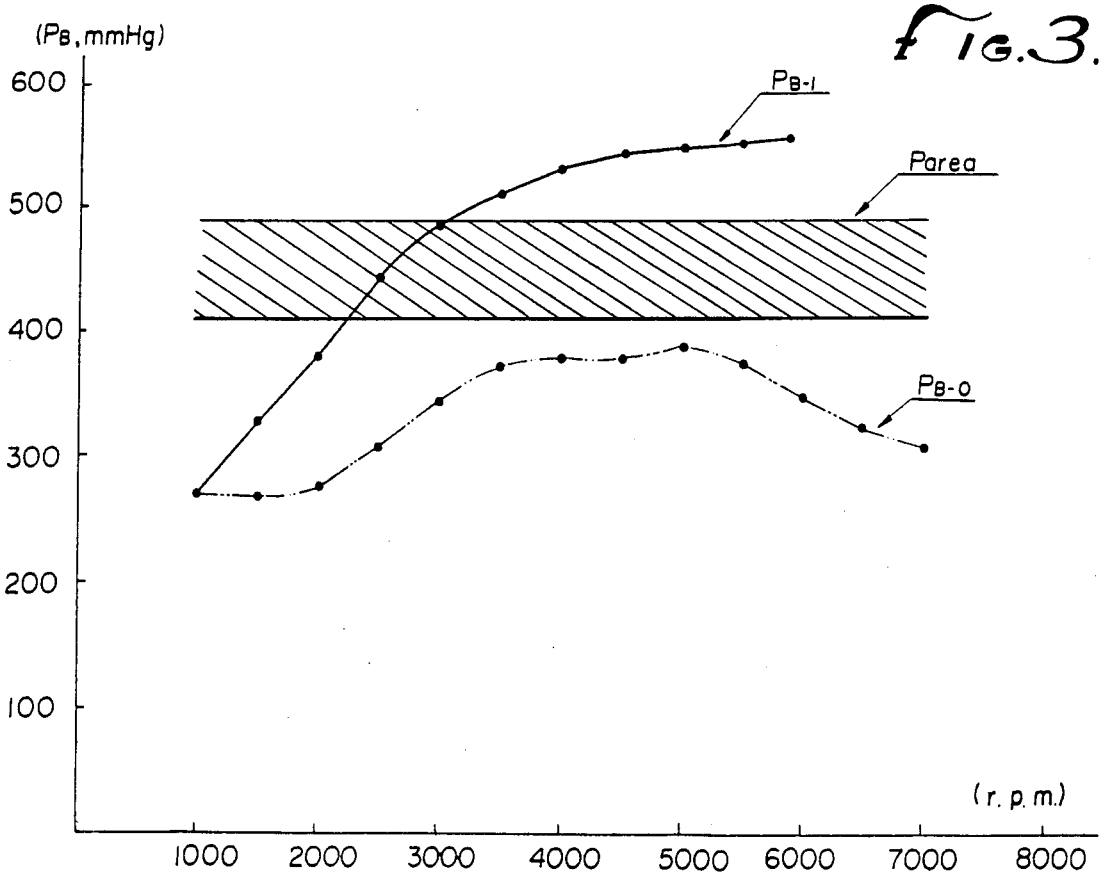
FIG. 3 is a graph illustrating manifold vacuum versus engine speed during engine braking and running conditions.

The selection of the diaphragm 72 and bias spring 76 is designed to achieve a closure of the control valve 58 under selected conditions. In the present example the valve is designed to close at 450±40 mmHg. This range is depicted as Parea in the graph of FIG. 3. The pressure trace indicated as $P_{B\text{-}0}$ is normal operation of the motorcycle without engine braking. With engine braking, the vacuum within the intake passage 28 is depicted by line $P_{B\text{-}1}$. Clearly, during engine braking, when the throttle valve 30 is substantially closed and the engine rpm's are elevated, the vacuum within the intake passage 28 is sufficient to actuate the valve controller 60. Thus, the control valve 58 is closed and the float chamber 38 may become pressurized. In turn, additional fuel flow is experienced through the jet passage 52 to enrichen the mixture entering the engine.

Figure 4:
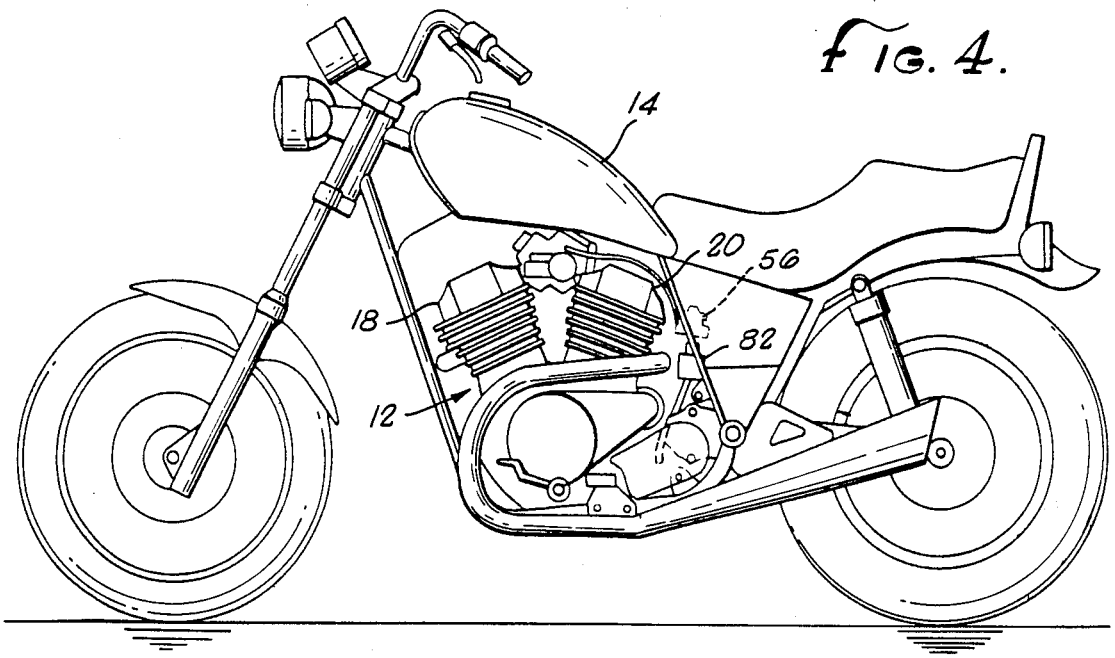
FIG. 4 is a side elevation of another motorcycle employing a device of the present invention.
Figure 5:
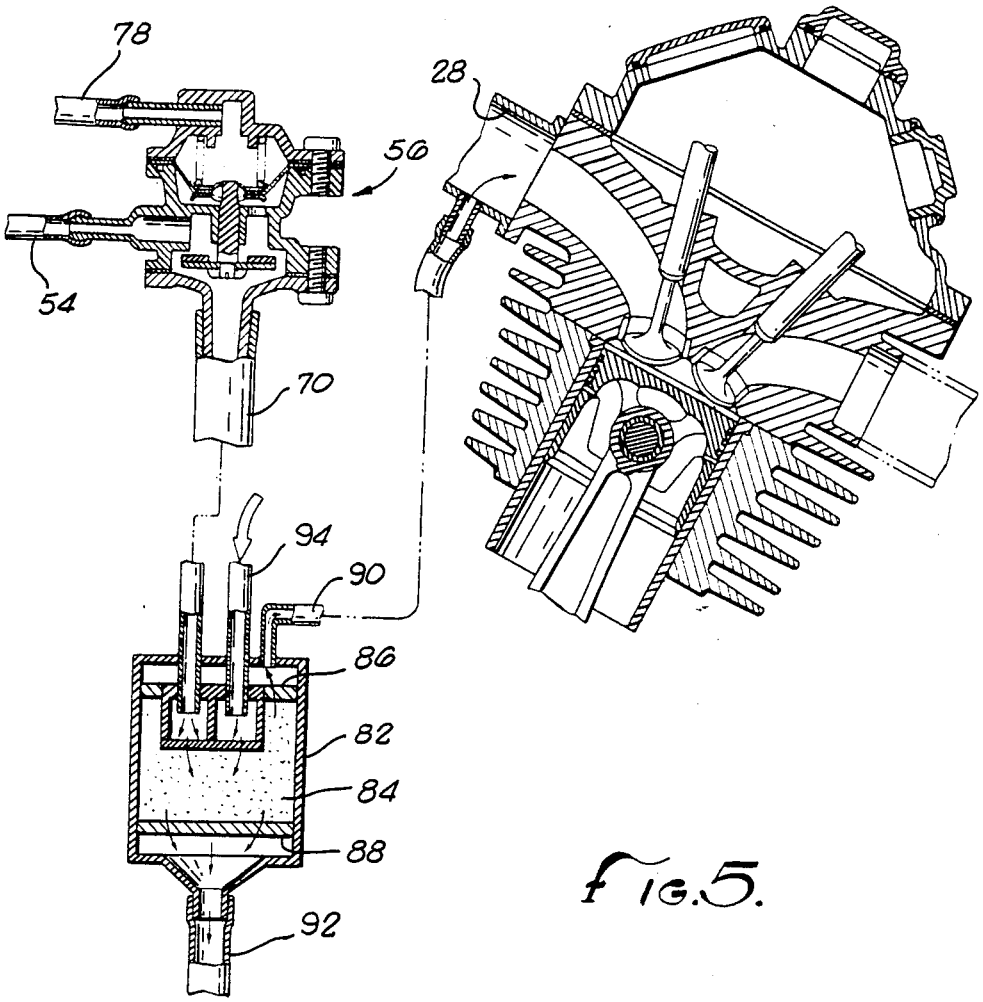
FIG. 5 is a cross-sectional elevation of the device employed with the motorcycle of FIG. 4.

Looking next to the embodiment of FIGS. 4 and 5, the vent passage 70 is shown to be directed to a canister 82 rather than to the air cleaner 22. This embodiment, as all embodiments in the present specification, employs the same reference numerals as used on corresponding parts in other embodiments. The canister 82 is filled with fuel absorbing material 84. With porous members 86 and 88 detaining the material 84, air is allowed to flow through the canister 82. Any fuel entrained with the air flow is collected by the fuel absorbing material 84 and is slowly and continuously drawn back into the intake passage 28 of the engine through the passage 90. The passage 90 is separated from both the vent passage 70 and an outlet passage 92 such that fuel will be drawn from the fuel absorbing material. An overflow passage 94 may also direct entrained fuel and the like to the canister 84.

Figure 6:
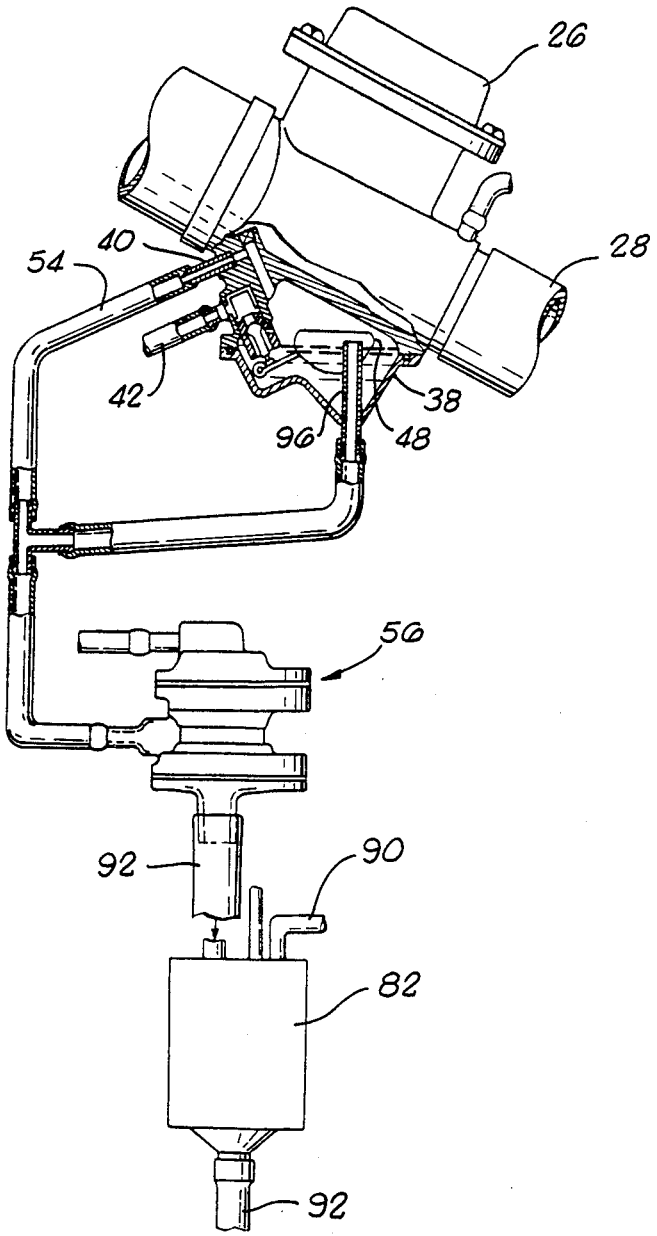
FIG. 6 is an elevation of another embodiment of the present invention.

Another embodiment is illustrated in FIG. 6. This embodiment of FIG. 6 differs from the prior embodiment in that an overflow system is employed for the float chamber 38. The overflow system includes an overflow tube 96 which is positioned within the float chamber 38 at an appropriate level to prevent fuel from filling the float chamber 38 above a predetermined level. The overflow tube 96 extends into communication with the tube 54 of the air vent passage 40. In this way, the overflow tube 96 is controlled identically to the air vent passage 40 by means of the air/fuel ratio control device 56. As a result, the overflow tube 96 does not provide a means by which the float chamber 38 can become depressurized during operation of the air/fuel ratio control device 56.

Figure 8:
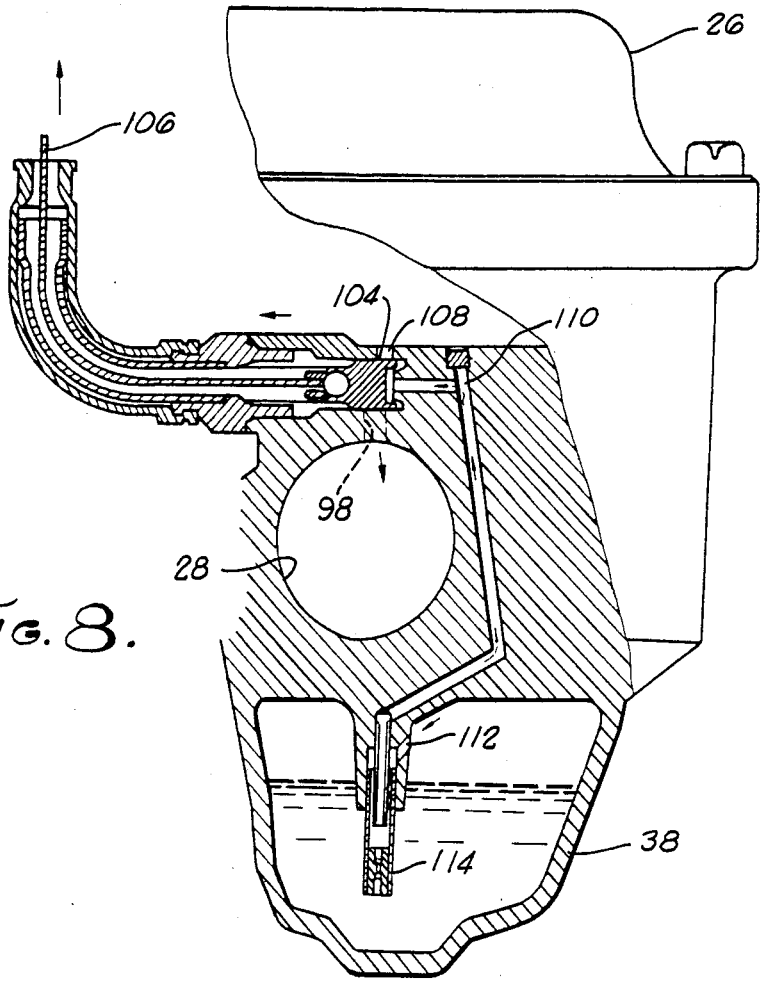
FIG. 8 is a cross-sectional view taken alone line 8—8 of FIG. 7.
Figure 7:
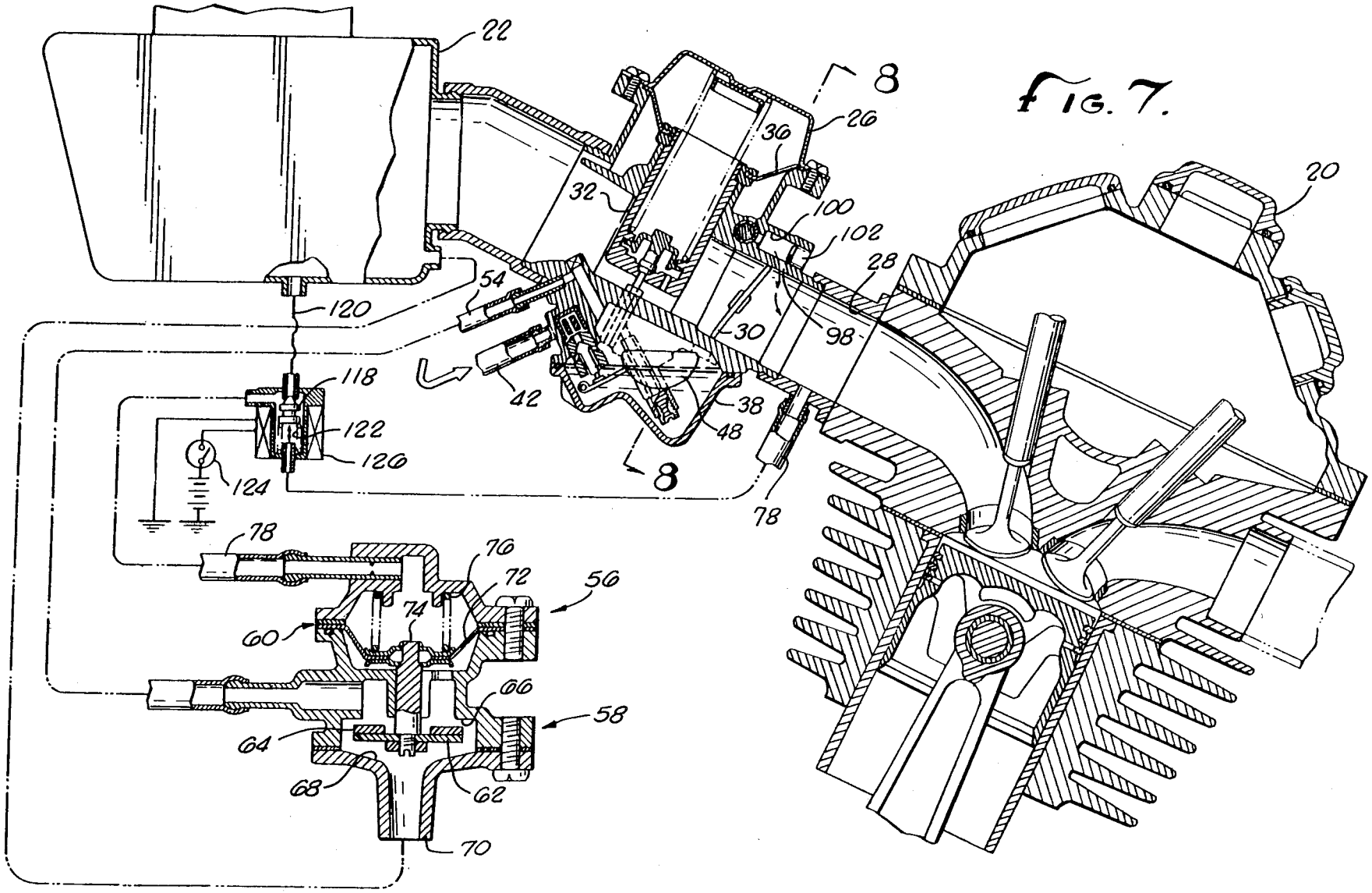
FIG. 7 is a cross-sectional elevation of an intake system for an internal combustion engine illustrating yet another embodiment of the present invention.

Looking next to the embodiment of FIGS. 7 and 8, the present invention is illustrated as being employed with a bistarter choke means for selective enrichment of the air/fuel mixture during warm-up operations and the like. The choke system illustrated in FIG. 7 includes a port 98 for introducing a rich air/fuel mixture to the intake passage 8. The port 98 is in communication with a passageway 100 closed by a plug 102.

In order to better understand the operation of the bistarter, reference is made to FIG. 8. In FIG. 8, a piston 104 actuated by a cable 106 controls the operation of the choke system with the piston 104 extending forwardly to the right as seen in FIG. 8, all passages are closed and the choke system is off. With the piston 104 retracted to the left, a passage 108 is opened to the air cleaner. A choke fuel passage 110 is also open. The vacuum within the intake passage 28 draws air through passage 108 and air and fuel through choke fuel passage 110 which collects to enter the intake passage 28 through port 98. Air and fuel are initially mixed for introduction to the choke fuel passage 110 in the float chamber 38. A choke fuel/air inlet 112 directs air to the end of the choke fuel passage 110. A fuel jet 114 mixes fuel with the incoming air, the mixture being drawn through the choke fuel passage 110.

The employment of a bistarter device such as described in this embodiment affects the operation of the air/fuel ratio control device because it creates a suction within the float chamber 38. Thus, the pressure within the float chamber 38 cannot be controlled through closure of the control valve. In the embodiment of FIG. 7, a simple switching mechanism is used to activate a shut-off valve. The shut-off valve acts to disable the valve controller 60 when the choke is activated.

The shut-off valve 116 includes an electromagnetic control. A valve member 118 is biased to close off a passage 120 leading to the air cleaner 22. A bias spring 122 acts to hold the valve member 118 in that position. The vacuum line 78 thus remains open. When the choke is enabled, a switch 124 is closed, activating a solenoid coil 126. The solenoid draws the valve member 118 downwardly to open the passage 120. Thus, atmospheric air is admitted to the vacuum line 78. In this way, the valve controller 60 is disabled.

Figure 9:
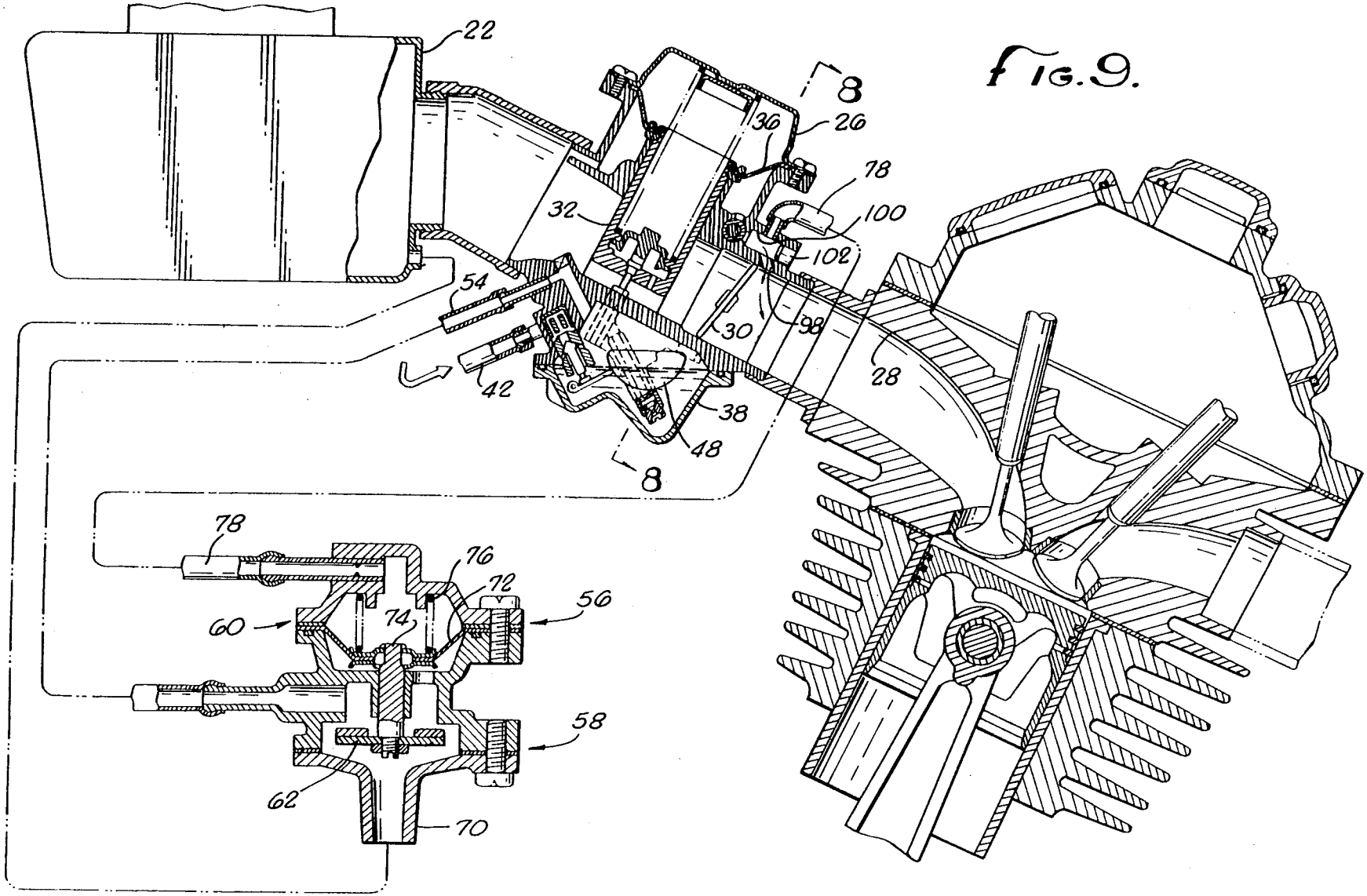
FIG. 9 is a cross-sectional elevation of an intake system for an internal combustion engine illustrating yet another embodiment configuration.

Looking to the embodiment of FIG. 9, it is noted that FIG. 8 applies equally to this embodiment. In the embodiment of FIG. 9, a shutoff valve is not employed to disable the air/fuel ratio control device 56 when the choke is activated. Rather, the vacuum line 78 is coupled directly with the passageway 100 leading from the choke mechanism. The passageway 100 is open to the port 98 through which choke mixture may flow. Because of the relative sizes of the passageways, the passageway 100 experiences less efficient vacuum than the intake passage 28 with the choke in operation. Incoming flow from the choke to the passageway 100 elevates the pressure in that passage. As a result, the valve controller 60 is deactivated without sufficient vacuum input. When the choke is in operation, the float chamber 38 is continuously vented by the foregoing mechanism.

Thus, an improved control system and the apparatus therefor for regulating air/fuel mixture in a carbureted intake system are disclosed. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A fuel supply system for a carburetor of an engine, comprising a sealed float chamber;

fuel inlet means to said float chamber for supplying fuel thereto;

fuel jet passage means for delivering fuel from said float chamber for carburetion;

an air vent passage from said float chamber;

a control valve in said vent passage; and a valve controller responsive to a selected level of engine intake vacuum to close said control valve.

2. The fuel supply system of claim 1 wherein said fuel inlet means supplies fuel under pressure above atmospheric to said float chamber.

3. The fuel supply system of claim 1 wherein said valve controller includes a diaphram coupled to said control valve, a vacuum chamber on one side of said diaphragm, and a bias spring, said vacuum chamber being in communication with the intake passage of the engine.

4. The fuel supply system of claim 3 wherein said bias spring prevents closure of said control valve except when the engine is above idle and the intake throttle valve is substantially closed.

5. An intake system of a vehicle engine, comprising an intake passage;

a carburetor in said intake passage, including a throttle valve, a sealed float chamber, a fuel jet passage for delivering fuel from said float chamber for carburetion, a fuel inlet to said float chamber, an air vent passage from said float chamber to atmosphere, a control valve in said vent passage, a valve controller responsive to a selected minimum level of engine intake vacuum in said intake passage when the engine speed is above idle and said throttle valve is substantially closed to close said control valve and seal said float chamber.

6. The intake system of claim 5 wherein said fuel inlet supplies fuel under pressure above atmospheric to said float chamber.

7. The intake system of claim 5 wherein said valve controller includes a diaphragm coupled to said control valve, a vacuum chamber on one side of said diaphragm, and a bias spring, said vacuum chamber being in communication with said intake passage.

8. The intake system of claim 7 wherein said bias spring prevents closure of said control valve except when the engine speed is above idle and the intake throttle valve is substantially closed.

9. The intake system of claim 5 wherein said fuel inlet includes a float valve and a float, said float being mounted about a pivot within said float chamber with said pivot forwardly of said float in the vehicle.

10. The intake system of claim 9 wherein said float valve is between said pivot and said float.

11. The intake system of claim 5 further comprising a canister containing fuel absorbing material, said canister being in communication with said air vent passage and atmosphere.

12. An intake system of a vehicle engine of an automobile, comprising an intake passage;

a carburetor in said intake passage, including a throttle valve, a sealed float chamber, a fuel jet passage for delivering fuel from said float chamber for carburetion, a fuel inlet to said float chamber, an air vent passage from said float chamber to atmosphere, a control valve in said vent passage, a valve controller having a vacuum line extending from said valve controller to said intake passage, said valve controller being responsive to a selected minimum level of engine intake vacuum in said intake passage to close said control valve, a choke means for selectively enrichening the carburetion, and a shutoff valve in said vacuum line for closing said vacuum line when said choke is activated.

13. The intake system of claim 12 wherein said choke includes a bistarter having a choke fuel passage extending from said intake passage into said float chamber and a choke fuel air inlet to said choke fuel passage within said float chamber.

14. An intake system of a vehicle engine, comprising an intake passage;

a carburetor in said intake passage, including a throttle valve, a sealed float chamber, a fuel jet passage for delivering fuel from said float chamber for carburetion, a fuel inlet to said float chamber, an air vent passage from said float chamber to astmosphere, a choke including a bistarter having a choke fuel passage extending from said intake passage into said float chamber and a choke fuel air inlet to said choke fuel passage within said float chamber, a control valve in said vent passage, a valve controller having a vacuum line extending from said valve controller to said choke fuel passage, said valve controller being responsive to a selected minimum level of engine intake vacuum in said intake passage to close said control valve when said choke is not enabled.

15. An intake system of a vehicle engine comprising an intake passage;

a carburetor in said intake passage, including a throttle valve, a sealed float chamber, a fuel jet passage for delivering fuel from said float chamber for carburetion, a fuel inlet to said float chamber, an air vent passage from said float chamber to atmosphere, a control valve in said vent passage, a valve controller responsive to a selected minimum level of engine intake vacuum in said intake passage when the engine speed is above idle and said throttle valve is substantially closed to close said control valve and an overflow tube in said float chamber extending to said air vent passage.

16. A fuel supply system for a carburetor of an engine, comprising a sealed float chamber;

fuel inlet means to said float chamber for supplying fuel thereto;

fuel jet passage means for delivering fuel from said float chamber for carburetion;

an air vent passage from said float chamber;

a control valve in said vent passage; and a valve controller including a diaphragm coupled to said control valve, a vacuum chamber on one side of said diaphragm, and a bias spring, said vacuum chamber being in communication with the intake passage of the engine, said valve controller being responsive to engine braking to close said control valve whereby said vent to said float chamber is closed to atmosphere during engine braking.

17. A fuel supply system for a carburetor of an engine, comprising a sealed float chamber;

fuel inlet means to said float chamber for supplying fuel thereto;

fuel jet passage means for delivering fuel from said float chamber for carburetion;

an air vent passage from said float chamber;

a control valve in said vent passage; and a valve controller including a diaphragm coupled to said control valve, a vacuum chamber on one side of said diaphragm and a bias spring, said vacuum chamber being in communication with the intake passage of the engine and said bias spring preventing closure of said control valve except when the engine is above idle and the intake throttle valve is substantially closed, said valve controller being responsive to engine braking to close said control valve whereby said vent to said float chamber is closed to atmosphere during engine braking.

* * * * *